United States Patent [19]

Wang et al.

[11] 4,138,350

[45] Feb. 6, 1979

[54] COLLECTOR COMBINATION FOR NON-SULFIDE ORES COMPRISING A FATTY ACID AND A SULFOSUCCINIC ACID MONOESTER OR SALT THEREOF

[75] Inventors: Samuel S. Wang, Cheshire; Eugene L. Smith, Jr., Milford, both of Conn.

[73] Assignee: American Cyanamid Company, Stamford, Conn.

[21] Appl. No.: 862,991

[22] Filed: Dec. 21, 1977

[51] Int. Cl.[2] ..... B03D 1/02; B03D 1/00

[52] U.S. Cl. ..... 252/61; 209/166

[58] Field of Search ..... 252/61; 209/166, 167; 560/151

[56] References Cited

U.S. PATENT DOCUMENTS

| | | | |
|---|---|---|---|
| 2,377,129 | 5/1945 | Christmann et al. | 209/166 |
| 2,562,154 | 7/1951 | Vitalis | 560/151 X |
| 3,102,856 | 9/1963 | Chase | 209/166 |
| 3,640,882 | 2/1972 | Groves | 560/151 X |

*Primary Examiner*—Harris A. Pitlick

*Attorney, Agent, or Firm*—William J. van Loo

[57] ABSTRACT

A combination of fatty acid and a monoester of sulfosuccinic acid or salt thereof provides improved recovery of non-sulfide ores by froth flotation.

10 Claims, No Drawings

COLLECTOR COMBINATION FOR NON-SULFIDE ORES COMPRISING A FATTY ACID AND A SULFOSUCCINIC ACID MONOESTER OR SALT THEREOF

CROSS-REFERENCE TO RELATED APPLICATION

This application is related to application Ser. No. 862,994 filed on even date herewith. The instant application relates to a collector combination of a fatty acid and a monoester of a sulfosuccinic acid or salt thereof. The related application relates to a process of froth flotation of non-sulfide ores using the collector combination.

This invention relates to a collector combination for the beneficiation of non-sulfide ores. More particularly, this invention relates to such a collector combination comprising a mixture of a fatty acid and a monoester of sulfosuccinic acid or a salt thereof.

Froth flotation is the principal means by which phosphate, barite, fluorite, hematite, taconite, magnetite and a host of other ores are concentrated. Its chief advantage lies in the fact that it is a relatively efficient process operating at substantially lower costs than many other processes.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with froth flotation to promote recovery of the desired material. The agents chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorption of heteropolar surface-active agents. The hydrophobic coating thus provided acts in this desirable to reduce the requirements for fatty acids which are constantly being diverted to nutritional and other uses. In view of the high quantities of non-sulfide minerals processed by froth flotation, such a development can result in a substantial increase in the total amount of mineral values recovered and provide substantial economic advantages even when a modest increase in recovery is provided. It is also highly desirable to have an efficient collector system for use at reduced dosage levels without sacrificing the mineral recovery performance. The decreases in reagent consumption are significant in view of the increasing diversion of fatty acids to nutritional and other uses. Accordingly, the provision for an improved collector combination for froth flotation of non-sulfide minerals would fulfill a long-felt need and constitute a notable advance in the art.

In accordance with the present invention, there is provided a collector combination for non-sulfide ores comprising from about 1 to about 99 weight percent of a fatty acid derived from a vegetable or animal oil and, correspondingly, from about 99 to about 1 weight percent of a monoester of a sulfosuccinic acid of the general formula

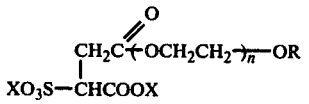

wherein R is an alkyl radical of about 4 to 18 carbon atoms, an aryl radical of one to two carbocyclic rings, an alkaryl radical of about 7 to 18 carbon atoms or an aralkyl radical of about 7 to 18 carbon atoms, n has a numerical value of about 0 to 12, and X is hydrogen, alkali metal or ammonium ion.

The collector combination provides superior performance in the froth flotation of non-sulfide ores over either component alone and leads to higher recovery and grade at low dosage requirements. In preferred instances, fatty acid requirements can be reduced by 50% while still providing high mineral recovery and grade.

The first essential ingredient comprising the collector combination of the present invention is a fatty acid derived from a vegetable or animal oil. Illustrative vegetable oils include babassu, castor, Chinese tallow, coconut, corn, cottonseed, grapeseed, hempseed, kapok, linseed, wild mustard, oiticica, olive, ouri-ouri, palm, palm kernel, peanut, perilla, poppyseed, Argentine rapeseed, rubberseed, safflower, seasame, soybean, sugarcane, sunflower, tall, teaseed, tung, and ucuhuba oils. Animal oils include fish and livestock oils. These oils contain acids ranging from six to twenty-eight carbon atoms or more which may be saturated or unsaturated, hydroxylated or not, linear or cyclic and the like.

The second essential ingredient comprising the collector combination of the present invention is a monoester of a sulfosuccinic acid of the general formula

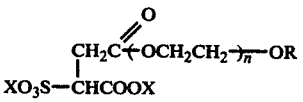

wherein R is an alkyl radical of about 4 to 18 carbon atoms, an aryl radical of one to two carbocyclic rings, an alkaryl radical of about 7 to 18 carbon atoms or an aralkyl radical of about 7 to 18 carbon atoms, n has a numerical value of about 0 to 12, and X is hydrogen, alkali metal or ammonium ion. Illustrative compounds of this structure include

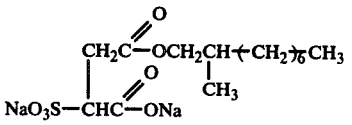

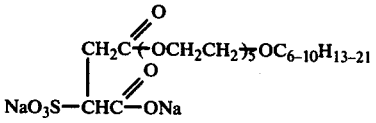

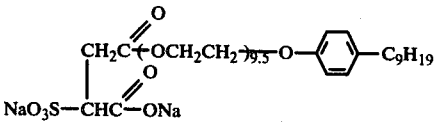

as well as the corresponding free acids, potassium salts and ammonium salts thereof.

As indicated, the collector combination will comprise from about 1 to about 99 weight percent of a fatty acid derived from a vegetable or animal oil and, correspondingly, from about 99 to about 1 weight percent of the monoester of sulfosuccinic acid or salt thereof. A preferred collector combination is one containing about 70 to 97 weight percent of fatty acid and, correspondingly, from about 30 to 3 weight percent of the monoester of sulfosuccinic acid or salt thereof.

In carrying out froth flotation of a non-sulfide ore using the collector combination of the present invention, a non-sulfide mineral capable of froth flotation with a fatty acid is selected. Such minerals include phosphate, fluorite, barite, hematite, taconite, magnetite, fluorspar and the like. The selected mineral is screened to provide particles of flotation size according to conventional procedures. Generally, the flotation size will encompass from about 35 to 200 mesh size particles.

After the selected mineral has been sized as indicated, it is slurried in aqueous medium and conditioned with an effective amount of the collector combination. Generally, an effective amount will be in the range of about 0.1 to 2.0 pounds per ton of ore but variations outside this range may occur depending upon such variables as the specific non-sulfide ore processed, the nature and amount of gangue material present, the particular values of recovery and grade desired and the like.

In addition to the collector combination, conditioning may also include such other reagents as are conventionally employed. The non-sulfide ores are generally processed at a pH value in the range of about 6.0 to 12.0, preferably 8.0 to 10.0. Accordingly, suitable pH regulators may be used as well as frothers, fuel oil and the like.

After the slurry is conditioned, it is subjected to froth flotation following conventional procedures. The desired mineral values are recovered with the froth and the gangue remains behind.

The invention is more fully illustrated in the examples which follow wherein all parts and percentages are by weight unless otherwise specified. The following general procedure is employed in the froth flotation examples given.

GENERAL PROCEDURE

Rougher Float

Step 1:

Secure washed and sized feed, e.g., 35 × 150 mesh screen fractions. Typical feed is usually a mixture of 23% coarse with 77% fine flotation particles.

Step 2:

Sufficient wet sample, usually 640 grams, to give a dry weight equivalent of 500 grams. The sample is washed once with about an equal amount of tap water. The water is carefully decanted to avoid loss of solids.

Step 3:

The moist sample is conditioned for 1 minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4:

Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5:

The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

COMPARATIVE EXAMPLE A

Following the general procedure using Florida pebble phosphate, a series of froth flotations were run following conventional procedures. The flotations were run at pH 9.0 using varying dosages of a fatty acid derived from tall oil in conjunction with No. 5 fuel oil, the dosage of fuel oil being equal to the dosage of fatty acid. Results and test details are given in Table I which follows.

TABLE I

PHOSPHATE ROCK FLOTATION WITH FATTY ACID

| Run | Dosages Fatty Acid (lbs. ton) | Dosages Fuel Oil (lbs. ton) | Weight Recovery (%) | BPL % Feed | BPL % Tail | BPL % Concentrate | BPL Recovery (%) |
|---|---|---|---|---|---|---|---|
| 1 | 0.34 | 0.34 | 8.94 | 19.86 | 15.14 | 67.98 | 30.60 |
| 2 | 0.37 | 0.37 | 11.05 | 18.23 | 11.83 | 69.77 | 42.29 |
| 3 | 0.40 | 0.40 | 12.77 | 18.15 | 10.65 | 69.36 | 48.81 |
| 4 | 0.44 | 0.44 | 13.65 | 18.64 | 10.93 | 67.45 | 49.38 |
| 5 | 0.47 | 0.47 | 15.19 | 18.95 | 10.71 | 64.94 | 52.06 |
| 6 | 0.50 | 0.50 | 15.10 | 17.73 | 8.47 | 69.77 | 59.43 |

EXAMPLE 1

The procedure of Comparative Example A was followed in every material detail except that in place of the fatty acid used therein there was used a combination of the same fatty acid and a monoester of sulfosuccinic acid of the structure:

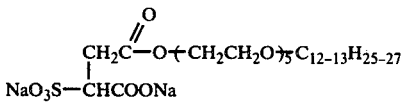

The sulfosuccinate was used as a replacement for varying proportions of the fatty acid and the total dosage was varied. In each instance the usage of No. 5 fuel oil was equal to the total dosage of the combination. Results and test details are given in Table II which follows.

TABLE II

| Run | Fatty Acid (Lbs/ton) | Surfactant (lbs/ton) | FA/S[1] Ratio | Fuel Oil (lbs/ton) | Weight Recovery (%) | % BPL Feed | % BPL Tail | % BPL Conc. | BPL Recovery (%) | Improvement Over Fatty Acid Alone[2] (%) |
|---|---|---|---|---|---|---|---|---|---|---|
| | FLOTATION WITH COMBINATION COLLECTOR | | | | | | | | | |
| | Dosages | | | | | | | | | |
| 1 | 0.258 | 0.082 | 74/26 | 0.34 | 16.23 | 18.47 | 8.47 | 70.07 | 61.58 | 101.0 |
| 2 | 0.300 | 0.070 | 81/19 | 0.37 | 16.21 | 17.95 | 7.79 | 70.49 | 63.64 | 50.5 |
| 3 | 0.368 | 0.032 | 92/8 | 0.40 | 17.39 | 18.24 | 7.01 | 71.56 | 68.24 | 39.8 |
| 4 | 0.422 | 0.018 | 96/4 | 0.44 | 19.06 | 18.54 | 6.17 | 71.09 | 73.07 | 48.0 |
| 5 | 0.451 | 0.019 | 96/4 | 0.47 | 19.69 | 20.08 | 7.57 | 71.09 | 69.72 | 33.9 |

Notes
[1]Ratio of Fatty Acid to Surfactant, respectively.
[2]Based on equal total dosage results in Table I.

EXAMPLE 2

The general procedure was again followed using a fatty acid derived from tall oil in conjunction with No. 5 fuel oil. In one run for comparative purposes, run 4 of Comparative Example A was repeated. In this example, 92% of the fatty acid was used in combination with 8% of a surfactant of the formula:

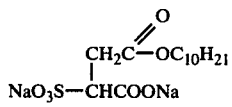

Results and test details are given in Table III which follows.

TABLE III

| Run | Fatty Acid (lbs/ton) | Surfactant (lb/ton) | Fuel Oil (lbs/ton) | Weight Recovery (%) | % BPL Feed | % BPL Tail | % BPL Conc. | BPL Recovery (%) | Improvement Over Fatty Acid (%) |
|---|---|---|---|---|---|---|---|---|---|
| | FLOTATION WITH FATTY ACID AND COLLECTOR COMBINATION | | | | | | | | |
| | Dosages | | | | | | | | |
| 4 of Comp. Ex. A | 0.44 | — | 0.44 | 13.65 | 18.64 | 10.93 | 67.45 | 49.38 | — |
| Example 2 | 0.405 | 0.035 | 0.44 | 14.32 | 18.70 | 10.19 | 69.95 | 53.31 | 8.0 |

EXAMPLE 3

The procedure of Example 2 was followed in every material detail except that the surfactant employed had the structure:

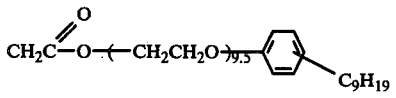

Results and test details are given in Table IV which follows:

TABLE IV

| Run | Fatty Acid (lbs/ton) | Surfactant (lbs/ton) | Fuel Oil (lbs/ton) | Weight Recovery (%) | %BPL Feed | %BPL Tail | %BPL Conc. | BPL Recovery (%) | Improvement Over Fatty Acid (%) |
|---|---|---|---|---|---|---|---|---|---|
| | FLOTATION WITH FATTY ACID AND COLLECTOR COMBINATION | | | | | | | | |
| | Dosages | | | | | | | | |
| 4 of Comp. Ex. A | 0.44 | — | 0.44 | 13.65 | 18.64 | 10.93 | 67.45 | 49.38 | — |
| Example 3 | 0.405 | 0.035 | 0.44 | 14.38 | 18.10 | 9.34 | 70.26 | 55.82 | 13.0 |

EXAMPLE 4

The procedure of Example 1 was again followed using crude tall oil and the same surfactant but using recycled motor oil at double the dosage of collector or combination. Details and results are given in Table V.

TABLE V

| Run | Fatty Acid (lbs/ton) | Surfactant (lbs/ton) | FA/S' Ratio | Recycled Motor Oil (lbs/ton) | Weight Recovery (%) | % BPL Feed | % BPL Tail | % BPL Conc. | BPL Recovery (%) |
|---|---|---|---|---|---|---|---|---|---|
| | FLOTATION WITH COMBINATION COLLECTOR | | | | | | | | |
| 1 | 0.4 | — | 100/0 | 0.8 | 4.41 | 14.66 | 12.70 | 57.19 | 17.20 |
| 2 | 0.38 | 0.02 | 95/5 | 0.8 | 12.32 | 15.34 | 9.46 | 52.23 | 45.95 |
| 3 | 0.36 | 0.04 | 90/10 | 0.8 | 15.95 | 15.03 | 7.12 | 56.72 | 60.19 |
| 4 | 0.32 | 0.08 | 80/20 | 0.8 | 20.82 | 15.71 | 4.91 | 56.78 | 75.25 |
| 5 | 0.28 | 0.12 | 70/30 | 0.8 | 22.63 | 15.58 | 3.81 | 55.84 | 81.08 |
| 6 | 0.24 | 0.16 | 60/40 | 0.8 | 21.66 | 15.02 | 3.86 | 55.32 | 79.86 |
| 7 | 0.20 | 0.20 | 50/50 | 0.8 | 22.66 | 15.31 | 2.71 | 58.31 | 86.31 |
| 8 | 0.16 | 0.24 | 40/60 | 0.8 | 26.61 | 14.67 | 2.26 | 48.89 | 88.69 |

TABLE V-continued

| FLOTATION WITH COMBINATION COLLECTOR | | | | | | | | | |
|---|---|---|---|---|---|---|---|---|---|
| Run | Fatty Acid (lbs/ton) | Surfactant (lbs/ton) | FA/S' Ratio | Recycled Motor Oil (lbs/ton) | Weight Recovery (%) | % BPL Feed | % BPL Tail | % BPL Conc. | BPL Recovery (%) |
| 9 | 0.12 | 0.28 | 30/70 | 0.8 | 27.55 | 15.14 | 3.20 | 46.54 | 84.69 |
| 10 | 0.08 | 0.32 | 20/80 | 0.8 | 28.50 | 14.48 | 2.87 | 43.59 | 85.82 |
| 11 | 0.04 | 0.36 | 10/90 | 0.8 | 29.99 | 14.61 | 3.86 | 39.70 | 81.50 |
| 12 | 0 | 0.40 | 0/100 | 0.8 | 23.47 | 14.69 | 4.42 | 48.18 | 76.97 |

We claim:

1. A collector combination for non-sulfide ores comprising from about 1 to about 99 weight percent of a fatty acid derived from a vegetable or animal oil and, correspondingly, from about 99 to about 1 weight percent of a monoester of a sulfosuccinic acid of the general formula

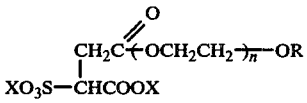

wherein R is an alkyl radical of about 4 to 18 carbon atoms, an aryl radical one to two carbocyclic rings, an alkaryl radical of about 7 to 18 carbon atoms or an aralkyl radical of about 7 to 18 carbon atoms, n has a numerical value of about 0 to 12, and X is hydrogen, alkali metal or ammonium ion.

2. The collector combination of claim 1 wherein said monoester of sulfosuccinic acid has the structure:

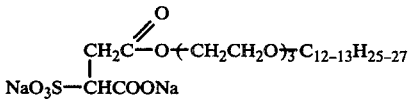

3. The collector combination of claim 1 wherein said monoester of sulfosuccinic acid has the structure:

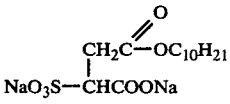

4. The collector combination of claim 1 wherein said monoester of sulfosuccinic acid has the structure:

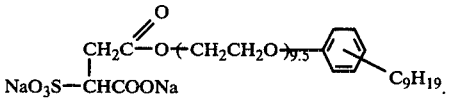

5. The collector combination of claim 1 wherein said fatty acid is derived from tall oil.

6. The collector combination of claim 1 comprising from about 70 to about 97 weight percent of said fatty acid and from about 30 to 3 weight percent of said monoester of a sulfosuccinic acid.

7. The collector combination of claim 1 comprising from about 74 to about 95 weight percent of said fatty acid and from about 26 to about 4 weight percent of said monoester of a sulfosuccinic acid.

8. The collector combination of claim 1 wherein said fatty acid is derived from tall oil and said monoester of a sulfosuccinic acid has the structure:

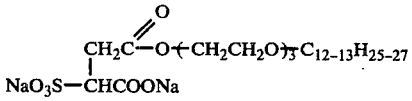

9. The collector combination of claim 1 wherein said fatty acid is derived from tall oil and said monoester of sulfosuccinic acid has the structure:

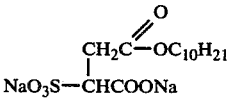

10. The collector combination of claim 1 wherein said fatty acid is derived from tall oil and said monoester of a sulfosuccinic acid has the structure:

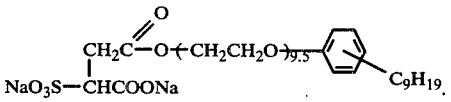

* * * * *